US008696156B2

(12) United States Patent
Yuan et al.

(10) Patent No.: US 8,696,156 B2
(45) Date of Patent: Apr. 15, 2014

(54) LED LIGHT BULB WITH LIGHT SCATTERING OPTICS STRUCTURE

(75) Inventors: Chuan Yuan, Eindhoven (CN); Yun Li, Eindhoven (CN); Mo Shen, Eindhoven (NL); Zhigang Pei, Eindhoven (CN); Ye Liu, Eindhoven (CN)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/996,806

(22) PCT Filed: Dec. 19, 2011

(86) PCT No.: PCT/IB2011/055763

§ 371 (c)(1),
(2), (4) Date: Jun. 21, 2013

(87) PCT Pub. No.: WO2012/085809

PCT Pub. Date: Jun. 28, 2012

(65) Prior Publication Data

US 2013/0285531 A1 Oct. 31, 2013

(30) Foreign Application Priority Data

Dec. 22, 2010 (WO) ..... PCT/CN2010/080099

(51) Int. Cl.
*F21V 5/00* (2006.01)
*F21V 5/08* (2006.01)

(52) U.S. Cl.
USPC ..... 362/236; 362/244; 362/246; 362/326; 362/333; 362/336

(58) Field of Classification Search
USPC ..... 362/235–248, 308–309, 362/311.01–311.15, 326–340
See application file for complete search history.

(56) References Cited

U.S. PATENT DOCUMENTS

| | | | | |
|---|---|---|---|---|
| 5,749,646 | A | 5/1998 | Brittell | |
| 6,502,956 | B1 | 1/2003 | Wu | |
| 6,637,921 | B2 * | 10/2003 | Coushaine | 362/517 |
| 7,600,882 | B1 | 10/2009 | Morejon et al. | |
| 2003/0185005 | A1 | 10/2003 | Sommers et al. | |
| 2006/0291209 | A1 * | 12/2006 | Booth et al. | 362/247 |
| 2010/0097802 | A1 * | 4/2010 | Jurik | 362/235 |
| 2010/0254133 | A1 * | 10/2010 | Cheng | 362/235 |
| 2011/0211350 | A1 * | 9/2011 | Klipstein et al. | 362/244 |

FOREIGN PATENT DOCUMENTS

| | | | |
|---|---|---|---|
| EP | 1610054 | A2 | 12/2005 |
| EP | 2071232 | A1 * | 6/2009 |
| JP | 2002208305 | A | 7/2002 |
| JP | 2003173701 | A | 6/2003 |
| JP | 2011062517 | A * | 3/2011 |
| WO | 2009150574 | A1 | 12/2009 |
| WO | 2010086257 | A1 | 8/2010 |

* cited by examiner

*Primary Examiner* — Mariceli Santiago
(74) *Attorney, Agent, or Firm* — Mark L. Beloborodov

(57) ABSTRACT

A LED light bulb (10, 110, 210) having at least one LED (30*a-d*, 230). Light output from the LED is directed toward an offset scattering optics structure (50, 150, 250) that intersects and scatters the light output. The LED may optionally be paired with a narrow beam optical piece (32*a-d*, 132*a-d*, 232) to focus and direct the light output of the LED toward the scattering optics structure. A mounting structure (40, 140, 240*a*, 240*b*) may support the scattering optics structure and offset the scattering optics structure from the LED.

17 Claims, 4 Drawing Sheets

LED LIGHT BULB WITH LIGHT SCATTERING OPTICS STRUCTURE

TECHNICAL FIELD

The present invention is directed generally to a LED light bulb. More particularly, various inventive methods and apparatus disclosed herein relate to a LED light bulb having at least one LED and a scattering optics structure offset from the LED that intersects and scatters light output from the LED.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects.

LED light bulbs are being developed as a replacement for traditional incandescent style light bulbs in order to achieve one or more of the aforementioned functional advantages and benefits of LEDs. Some LED light bulbs implement a plurality of LEDs mounted in a substantially planar relationship perpendicular to the rotational axis of the screw cap (the axis about which the LED light bulb is rotated when installing and removing the bulb from the socket). Such LED light bulbs may suffer from poor light distribution performance, especially when utilized in combination with a clear bulb envelope. Other LED light bulbs implement a plurality of LEDs mounted in a substantially vertical relationship parallel to the rotational axis of the screw cap. The LEDs in such LED light bulbs may be mounted on multiple vertically extending faces. For example, such LED light bulbs may include four rectangularly arranged distinct vertically extending faces each having a plurality of LEDs mounted thereon. Such LED light bulbs may suffer from poor thermal management of the heat generated by the LEDs and/or may suffer from limited total power output from the LEDs.

Thus, there is a need in the art to provide a LED light bulb that provides satisfactory light distribution performance and satisfactory thermal management and power output from the LEDs thereof.

SUMMARY

The present disclosure is directed to inventive methods and apparatus for a LED light bulb having at least one LED, with light output from the LED directed toward an offset optics structure that intersects and scatters the light output. For example, a plurality of LEDs may optionally be provided disposed on a mounting surface. The LEDs may each optionally be paired with a narrow beam optical piece to focus and direct the light output of the LEDs toward the scattering optics structure. A mounting structure may support the scattering optics structure and offset the scattering optics structure from the LEDs.

Generally, in one aspect, a LED light bulb is provided that includes a connection base having at least one electrical contact and a support atop the connection base. The LED light bulb also includes a plurality of LEDs coupled to the support and disposed about an axis. Each of the LEDs produces a LED light output and is electrically coupled to the electrical contact. The LED light bulb also includes a plurality of narrow beam optical pieces. Each of the optical pieces is provided adjacent a single of the LEDs and intersects at least some of the LED light output thereof. The intersected LED light output combines with any non-intersected LED light output to form modified LED light output that is of a narrower beam angle than the LED light output. A scattering optics structure is also provided that intersects the axis and is offset from the LEDs in a direction along the axis. A mounting structure is coupled to and supports the scattering optics structure. The mounting structure optionally extends from adjacent the LEDs in some embodiments. A lucent bulb structure surrounds at least the scattering optics structure. A majority of the modified LED light output is incident on the scattering optics structure and at least some of the modified LED light output is transmitted through the scattering optics structure. The scattering optics structure scatters the modified LED light output out and through the lucent bulb structure.

In some embodiments, the lucent bulb structure is transparent.

In some embodiments, the scattering optics structure includes a multi-faceted annular periphery. In some versions of those embodiments the scattering optics structure includes a recessed convex lower surface interior of the periphery and generally facing the LEDs.

In some embodiments, the LEDs are mounted in substantially planar relation to one another. In some versions of those embodiments the optical pieces are off-axis optical pieces, with each of the optical pieces redirecting the LED light output in a non-symmetrical fashion with respect to a central LED light output axis of a respective of the LEDs.

In some embodiments, at least three LEDs are provided and are substantially symmetrically positioned about the axis.

In some embodiments, the mounting structure is a single column extending along the axis. In some versions of those embodiments the column is concave and reflective at least between the optical pieces and the scattering optics structure.

In some embodiments, the modified LED light output has a beam angle of less than eleven degrees.

In some embodiments, the mounting structure extends from the lucent bulb structure.

Generally, in another aspect a LED light bulb is provided that includes a connection base having at least one electrical contact and a support atop the connection base. The connection base is centered on a longitudinally extending bulb axis. A plurality of LEDs are substantially symmetrically arranged within the LED light bulb about the bulb axis and each of the LEDs produces a LED light output. A scattering optics structure is centered on the bulb axis and is offset from the LEDs. A mounting structure is coupled to the support and is coupled to and supports the scattering optics structure. A lucent bulb structure surrounds at least the scattering optics structure. Each of a plurality of off-axis narrow beam optical pieces is provided adjacent a single of the LEDs and intersects at least some of the LED light output thereof. The intersected LED light output combines with any non-intersected LED light output to form modified LED light output having a beam angle of zero to twenty degrees. A substantial majority of the modified LED light output is incident on at least one of the scattering optics structure and the mounting structure. At least some of the modified LED light output is transmitted through the scattering optics structure. The scattering optics structure scatters the modified LED light output out and through the bulb structure.

In some embodiments, the connection base is of the Edison type.

In some embodiments, the LED light bulb further includes a bezel structure surrounding the LEDs and retaining the optical pieces.

In some embodiments, the scattering optics structure includes a recessed convex lower surface generally facing the LEDs. In some versions of those embodiments, the scattering optics structure includes a recessed concave surface opposite the convex surface.

In some embodiments, the mounting structure is lucent. In some versions of those embodiments the mounting structure is reflective.

In some embodiments, the LED light bulb further includes a first magnetic structure coupled to the scattering optics structure and a second magnetic structure vertically offset from the scattering optics structure and the first magnetic structure. The first magnetic structure and the second magnetic structure are arranged in a magnetically opposed manner with respect to one another, thereby causing the first magnetic structure and the scattering optics structure to be repelled away from the second magnetic structure.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
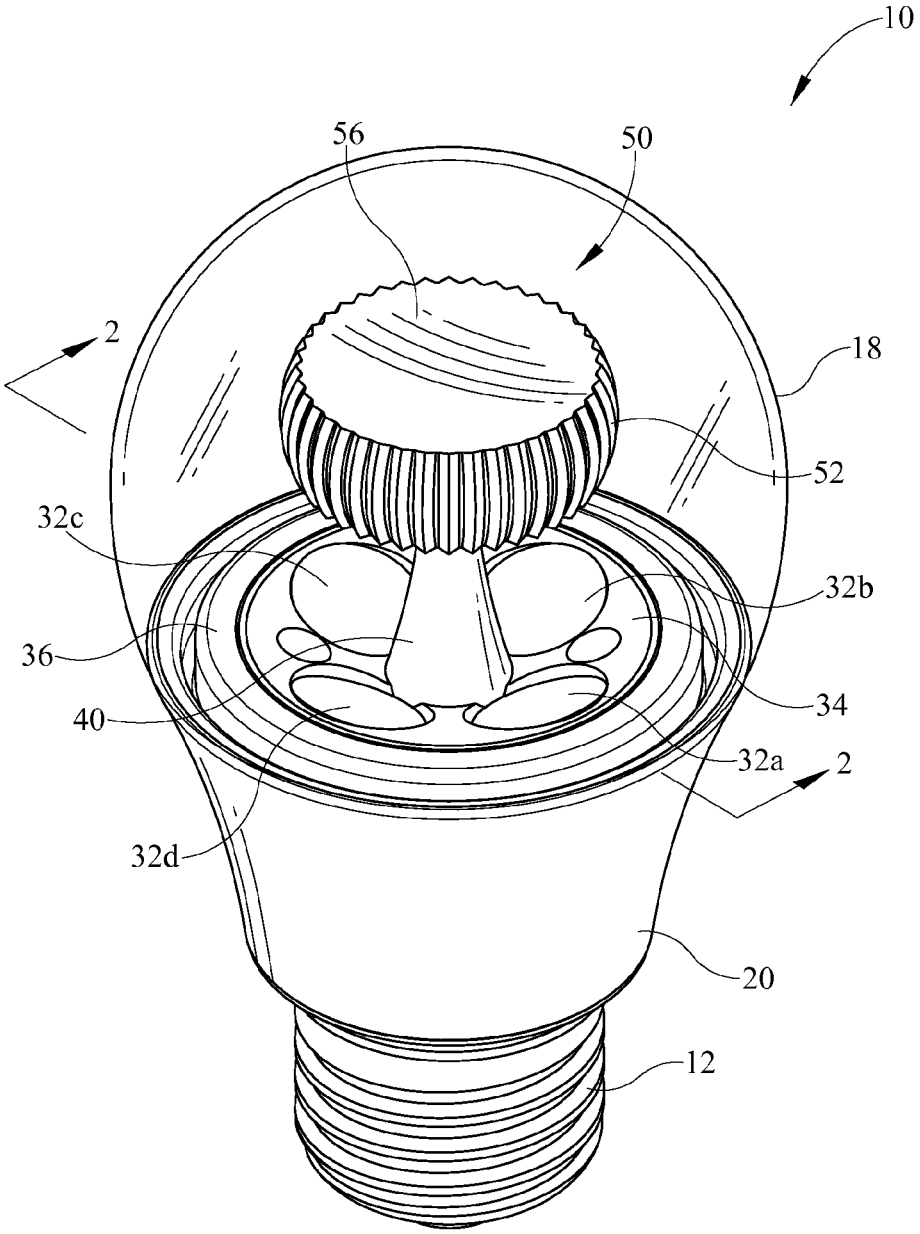
FIG. 1 illustrates a perspective view of a first embodiment of a LED light bulb.

LED light bulbs are being developed as a replacement for traditional incandescent style light bulbs in order to achieve one or more of the advantages and benefits of LEDs. Some LED light bulbs implement a plurality of LEDs mounted in a substantially planar relationship perpendicular to the rotational axis of the screw cap. Such LED light bulbs may suffer from poor light distribution performance. Other LED light bulbs implement a plurality of LEDs mounted in a substantially vertical relationship parallel to the rotational axis of the screw cap. Such LED light bulbs may suffer from poor thermal management of the heat generated by the LEDs and/or may suffer from limited total power output from the LEDs. Thus, the Applicants have appreciated and recognized that it would be beneficial to provide a LED light bulb having at least one LED with light output from the LED directed toward an offset optics structure that intersects and scatters the light output. The scattering optics structure may optionally be provided on a central axis (e.g., the rotational axis) of the LED light bulb and a plurality of LEDs may optionally be provided disposed about the central axis on a mounting surface. The LEDs may each optionally be paired with a narrow beam optical piece to focus and direct the light output of the LEDs toward the scattering optics structure.

More generally, Applicants have recognized and appreciated that it would be beneficial to provide a LED light bulb that provides satisfactory light distribution performance and satisfactory thermal management and power output from the LEDs thereof.

In view of the foregoing, various embodiments and implementations of the present invention are directed to a LED light bulb. More particularly, various inventive methods and apparatus disclosed herein relate to a LED light bulb having at least one LED and a scattering optics structure offset from the LED that intersects and scatters light output from the LED.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. For example, throughout the detailed description a LED light bulb is depicted that utilizes an Edison type screw cap electrical connection structure. However, one of ordinary skill in the art, having had the benefit of the present disclosure will recognize and appreciate that a LED light bulb according to the teachings hereof may utilize other electrical connection structure to electrically interface with a power source. For example, bayonet style connection structure, GU10 style connection structure, PL style connection structure, or proprietary connection structure may be utilized. Moreover, descriptions of well-known apparatuses and methods may be omitted so as to not obscure the description of the representative embodiments. Such methods and apparatuses are clearly within the scope of the claimed invention.

Figure 2:
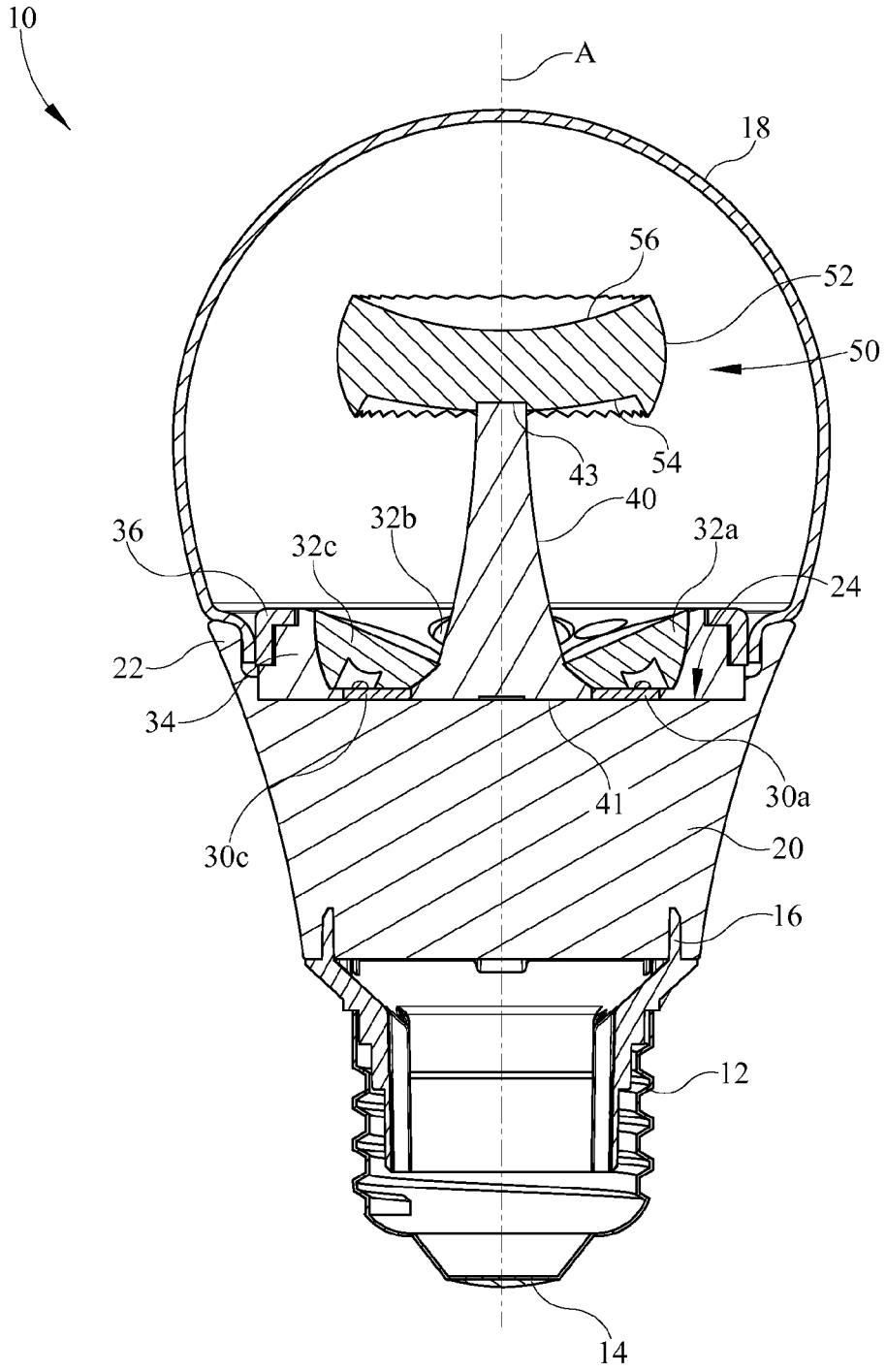
FIG. 2 illustrates a section view of the LED light bulb of FIG. 1 taken along the section line 2-2.

Referring initially to FIG. 1 and FIG. 2, in one embodiment, a LED light bulb 10 includes an Edison type screw cap connection base 12 having an electrical contact 14 (FIG. 2). The connection base 12 may be removably received in an Edison type socket of a lighting fixture. The connection base 12 is coupled to a support 20 via attachment structure 16 that extends upwardly from the connection base 12 and into support 20. The attachment structure 16 may include a plurality of chamfered biased clips that protrude from the connection base 12 and are received in corresponding openings of the support 20. In some embodiments the support 20 may comprise a material having advantageous heat dissipating characteristics such as, for example, aluminum or copper. The support 20 may optionally house electronics electrically interposed between the electrical contact 14 and LEDs 30*a-d* of the LED light bulb 10. For example, in some embodiments electrical wires that are interposed between the electrical contact 14 and the LEDs 30*a-d* may be housed within a wireway extending through the support 20. Also, for example, in some embodiments one or more LED drivers interposed between the electrical contact 14 and LEDs 30*a-d* may be housed by the support 20. In some embodiments one or more LED drivers may additionally or alternatively be housed within the connection base 12. In yet other embodiments, any LED drivers may be separate from the LED light bulb 10 (e.g., within other structure of a lighting fixture).

The support 20 includes a lip section 22 that surrounds a mounting surface 24. The mounting surface 24 supports a plurality of LEDs 30*a-d* that are circumferentially arranged on the mounting surface 24. The LEDs 30*a-d* are symmetrically arranged about a central axis A (FIG. 2) of the LED light bulb 10. The depicted central axis A is substantially aligned with the rotational axis of the LED light bulb 10. Each of the LEDs 30*a-d* is rotationally offset approximately ninety degrees about the central axis A with respect to the two most closely adjacent LEDs 30*a-d*. In some embodiments the LEDs 30*a-d* may share a substantially common configuration. In alternative embodiments, one or more of the LEDs 30*a-d* may emit light of color and/or intensity that is unique from the color and/or intensity emitted by at least one other of the LEDs 30*a-d*.

Each of the LEDs 30*a-d* is provided with a single of narrow beam optical pieces 32*a-d* thereover. The narrow beam optical pieces 32*a-d* are retained by a bezel 34 that is coupled to mounting surface 24. The depicted narrow beam optical pieces 32*a-d* are off-axis optical pieces, meaning that they redirect LED light output from a respective LED 30*a-d* in a non-symmetrical fashion with respect to a central LED light output axis of that LED. Each central LED light output axis in the depicted embodiment is an axis emanating substantially from the center of the light emitting portion of a single of the LEDs 30*a-d* in a direction that is perpendicular to and away from the mounting surface 24. In the depicted embodiment the central LED light output axes are substantially parallel with the central axis A of the LED light bulb 10. In some embodiments the central LED light output axis may be along the centroidal axis of the theoretical LED light distribution.

As described in additional detail herein, a majority of the light output from the LEDs 30*a-d* as modified by the optical pieces 32*a-d* is directed toward a light scattering optics structure 50 that is offset from and positioned above the LEDs 30*a-d*. In the depicted embodiment the narrow beam optical pieces 32*a-d* are substantially frusto-conical in shape and are formed of a solid lucent medium such as, for example, optical grade acrylic. The exit face of each of the optical pieces 32*a-d* slopes downwardly closer to the mounting surface 24 as it moves more proximal to the central axis A. The outer reflective surface of the optical pieces 32*a-d* has a curvature that varies, having a curvature that increases with distance from the central axis A. In other words, the portion of outer reflective surface of the optical pieces 32*a-d* most proximal to the central axis A has less of a curvature than the portion most distal the central axis A. The optical pieces 32*a-d* redirect light emitted from a respective LED 30*a-d* along a path that is directed more so toward the central axis A than unaltered LED light output would be and that has a beam angle with a more narrow range than unaltered LED light output would be. In some embodiments the optical pieces 32*a-d* may redirect light within a beam angle of less than or equal to fifteen degrees. In some versions of those embodiments the beam angle may be less than or equal to seven degrees. Although only LEDs 30*a*, 30*c* and optical pieces 32*a*, 32*c* are depicted in FIG. 2, it is understood that LEDs 30*b*, 30*d* and optical pieces 32*b*, 32*d* have a similar configuration and would look the same in a similar section (e.g., a section offset ninety degrees about central axis A from the section of FIG. 2).

Although a particular configuration of LEDs 30*a-d* and optical pieces 32*a-d* is depicted in FIGS. 1 and 2, one of ordinary skill in the art having had the benefit of the present disclosure will recognize that in alternative embodiments alternative configurations may be utilized. For example, in some embodiments more or fewer LEDs 30*a-d* may be provided. Also, for example, in alternative embodiments the LEDs 30*a-d* may be mounted in a non-planar arrangement (e.g., one or more LEDs may be angled such that there optical axes are directed toward the central axis A, and/or one or more LEDs may be mounted at a different height relative to other LEDs). Also, for example, in some embodiments one or more of the optical pieces 32*a-d* may not be an off-axis optical piece. In some versions of those embodiments the corresponding LEDs 30*a-d* may be angled such that there optical axes are directed toward the central axis A. Also, for example, in some embodiments one or more of the optical pieces 32*a-d* may be omitted.

Attached to the LED mounting surface 24 centrally of the LEDs 32*a-d* and along the central axis A is a mounting structure 40 that is substantially shaped like a tapered column. The mounting structure 40 has a first end 41 that is coupled to the mounting surface 24 and tapers toward a narrower second end 43 that is coupled to the scattering optics structure 50. The exterior surface of the mounting structure 40 between the optical pieces 32*a-d* and the scattering optics structure 50 is concave. In some embodiments the exterior surface of the mounting structure 40 may be at least partially reflective by virtue of total internal reflection and/or a reflective coating. In some embodiments the mounting structure 40 may be a lucent material such as, for example, optical grade acrylic. In some versions of those embodiments the mounting structure 40 may reflect some light rays emitted from the LEDs 30*a-d* and incident thereon and may refract other light rays emitted from the LEDs 30*a-d* and incident thereon.

Atop the mounting structure 40 and supported thereby is the scattering optics structure 50. The scattering optics structure 50 has a substantially annular periphery 52 that has a plurality of angled facets or prisms provided thereabout. The prisms scatter and diffuse light that exits the optical piece 50 through the annular periphery 52. The annular periphery 52 is convex as viewed in cross-section in FIG. 2, having a more bowed out mid-section than upper and lower portions thereof. The scattering optics structure 50 also has a recessed convex lower surface 54 that generally faces the LEDs 30*a-d*. The recessed convex lower surface 54 is provided interiorly of the annular periphery 52 and includes a depression for receiving the second end 43 of the mounting structure 40. Located opposite of the recessed convex lower surface 54 and generally facing away from the LEDs 30*a-d* is a concave upper surface 56.

A majority of the light output exiting the optical pieces 32*a-d* is directed toward and is incident upon the light scattering optics structure 50. The light incident upon the light scattering optics structure 50 is refracted and/or reflected thereby and scattered out and through a lucent bulb 18 that surrounds the scattering optics structure 50. Some of the light output exiting the optical pieces 32*a-d* will be incident on the recessed convex lower surface 54, refract therethrough, and exit the scattering optics structure 50 either through the concave upper surface 54 or the annular periphery 52. It is understood that such light may experience one or more reflections internally of the scattering optics structure 50. Some of the light output exiting the optical pieces 32*a-d* will be incident on the recessed convex lower surface 54 and/or the angled portion extending between the convex lower surface 54 and the annular periphery 52 and be reflected out and through the lucent bulb 18. As described herein, some of the light output exiting the optical pieces 32*a-d* may also be incident on mounting structure 40 (either before, after, or independently of being incident upon the scattering optics structure 50) and either reflected or refracted therethrough. In some embodiments a substantial majority of the light output exiting the optical pieces 32*a-d* will be incident upon at least one of the scattering optics structure 50 and the mounting structure 40.

In some embodiments, the material of the scattering optics structure 50 may be a high transmittance material such as, for example, polycarbonate, acrylic, or silicon. In some embodiments the material of the scattering optics structure 50 may be a material that provides partial reflectance and partial transmittance such as, for example, some ceramic materials. In some embodiments a coating may be applied to all or portions of the scattering optics structure 50. For example, in some embodiments an aluminum coating may be applied to portions of the scattering optics structure 50. Such a coating may increase a sparkling effect of the optics structure 50 in some implementations. Also, in some embodiments, air bubbles, small particles, diffusing sheets, or other light altering impurity may be implanted into the scattering optics structure 50 to provide increased scattering via increased diffusion and/or reflection. The size and/or configuration of the scattering optics structure 50 may be defined according to, among other things, the beam angle of the light output exiting the optical pieces 32*a-d*, the distance between the LEDs 30*a-d* and the scattering optical structure 50, and/or the desired light output characteristics of the LED light bulb 10.

The lucent bulb 18 extends between the lip 22 of the housing 20 and an annular ring 36 that is provided atop and surrounding the bezel 34. The bulb 18 may optionally be retained in interference fit between the annular ring 36 and the lip 22 and/or may be coupled to the annular ring 36 and/or the lip 22 by an adhesive. In some embodiments the lucent bulb 18 may be transparent. In other embodiments the lucent bulb 18 may be diffuse or semi-diffuse.

Figure 3:
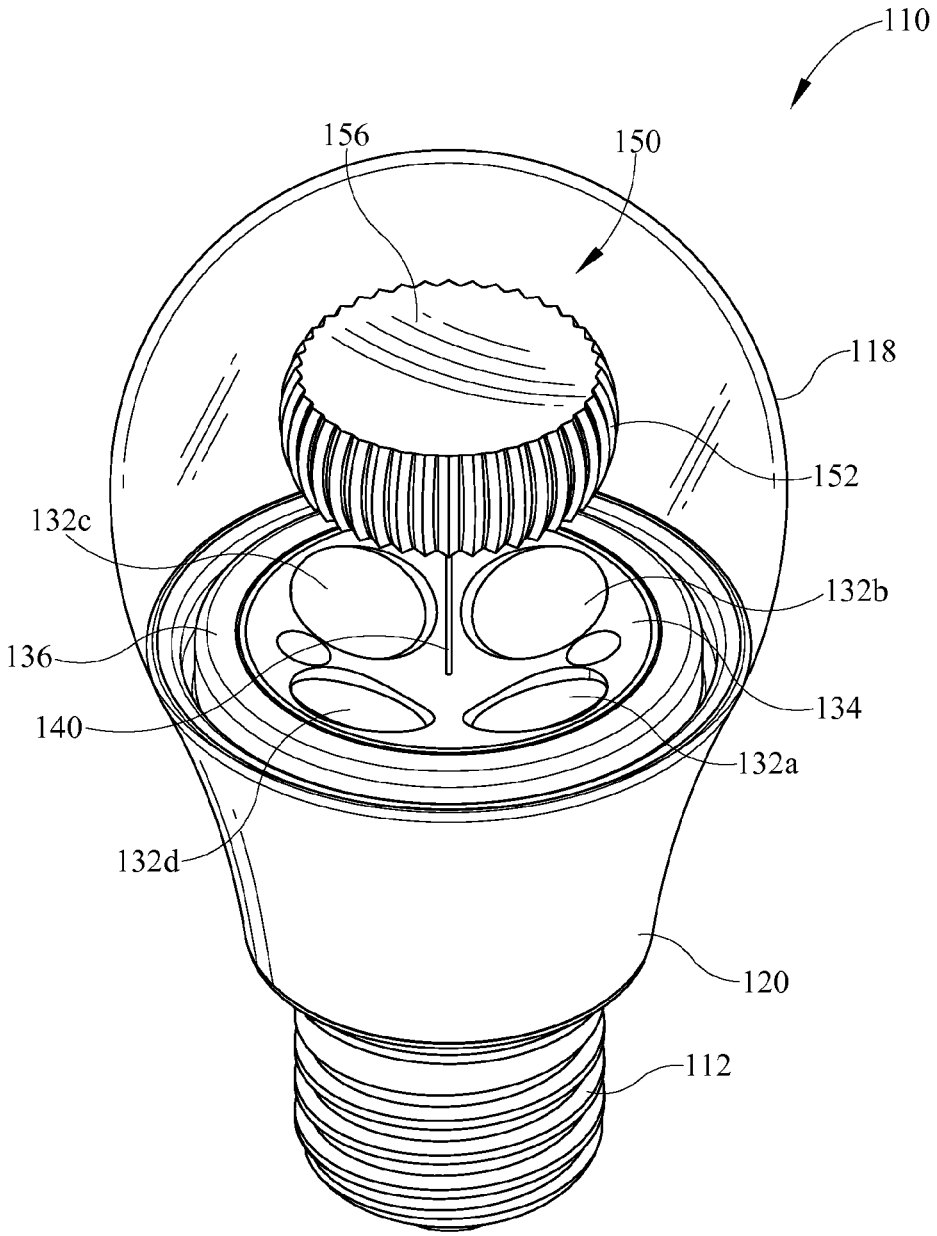
FIG. 3 illustrates a perspective view of a second embodiment of a LED light bulb.

Referring now to FIG. 3, a second embodiment of a LED light bulb 110 is illustrated. The second embodiment of the LED light bulb 110 shares a similar configuration with LED light bulb 10, except as described herein to the contrary. Moreover, similar numbering between LED light bulb 10 and LED light bulb 110 references similar parts having a substantially similar configuration, except as described herein to the contrary. For example, bulb 118 has a substantially similar configuration as bulb 18.

The thin rod mounting structure 140 is distinct from the mounting structure 40 depicted in FIGS. 1 and 2. For example, the thin rod mounting structure 140 is smaller in size. In some embodiments the thin rod mounting structure 140 may alone support the scattering optics structure 150. In other embodiments the thin rod mounting structure 140 may interface with repelling magnetic structure to support the scattering optics structure 150. For example, in some embodiments a first magnetic structure may be coupled to the scattering optics structure 150 (e.g., a magnetic sheet interiorly thereof or on part of a bottom or top surface thereof). A second magnetic structure (e.g., a permanent magnet or electromagnet) may be provided vertically offset below the scattering optics structure 150 in a location such as, for example, the support 120 and/or the bezel 134. The first magnetic structure and the second magnetic structure may be magnetically opposed with respect to one another, thereby causing the first magnetic structure and the scattering optics structure 150 to be repelled away from the second magnetic structure and helping to support the scattering optics structure 150. In some versions of those embodiments the thin rod mounting structure 140 may be replaced or supplemented with a plurality of thin strings to stabilize the scattering optics structure 150 against the repelling force created by the opposed magnets. The thin strings may extend, for example, between the scattering optics structure 150 and the bezel 134.

Figure 4:
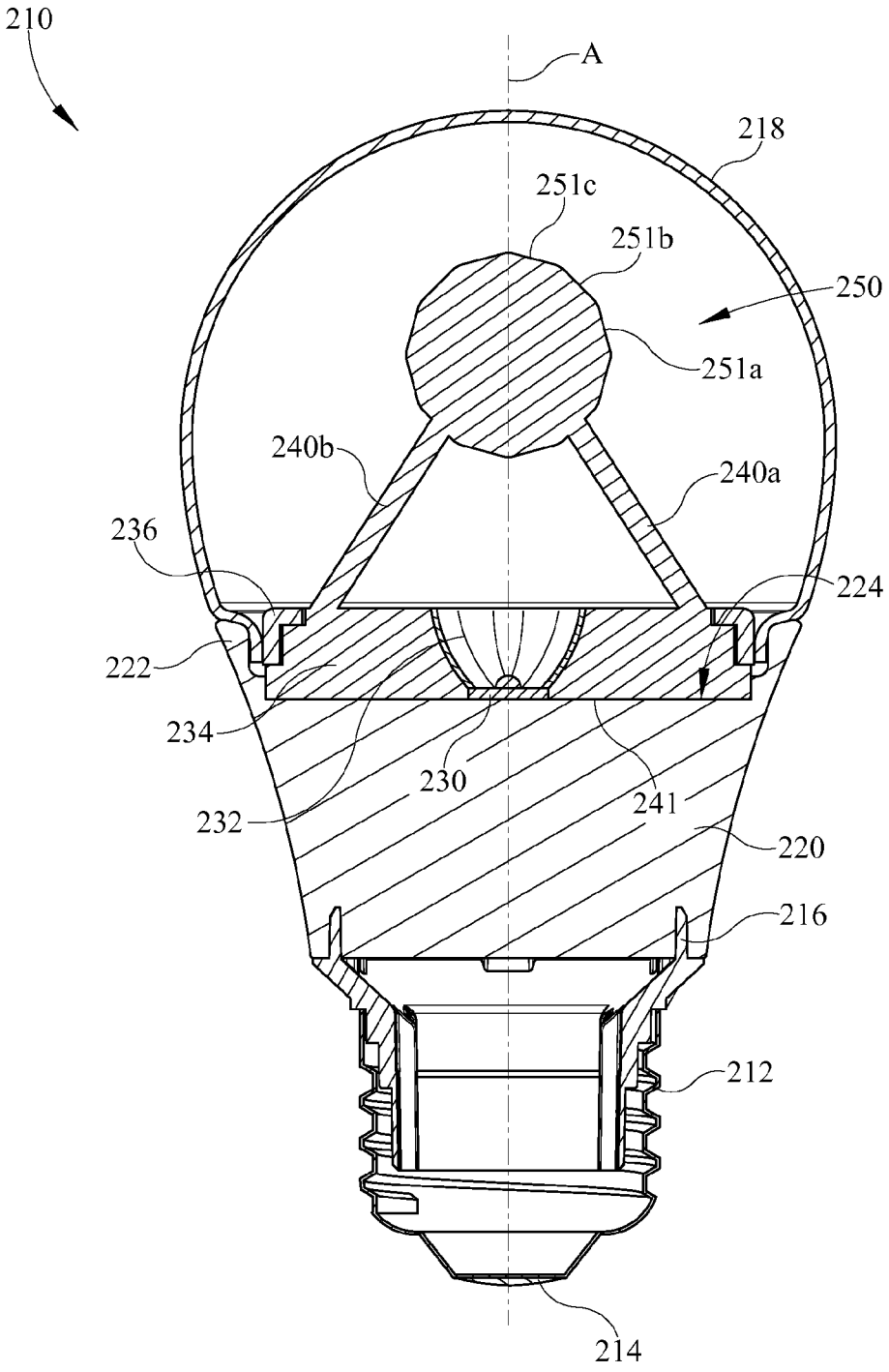
FIG. 4 illustrates a section view of a third embodiment of a LED light bulb.

Referring now to FIG. 4, a third embodiment of a LED light bulb 210 is illustrated. The third embodiment of the LED light bulb 210 shares a similar configuration with LED light bulb 10, except as described herein to the contrary. Moreover, similar numbering between LED light bulb 10 and LED light bulb 210 references similar parts having a substantially similar configuration, except as described herein to the contrary. For example, bulb 218 has a substantially similar configuration as bulb 18. The LED light bulb 210 only includes a single LED 230. The single LED 230 is provided with an on-axis narrowing optical piece 232 therearound. The optical piece 232 is a non-solid open air reflector provided in bezel 234. In alternative embodiments the optical piece 232 may be a solid optical piece. In some embodiments the optical piece 232 may be integrally formed in the bezel 234. In alternative embodiments the optical piece 232 may be omitted and the LED 230 may have a relatively narrow beam angle. For example, the LED 230 may be a laser LED.

The light scattering optics structure 250 is supported by a pair of angled legs 240*a*, 240*b* that are not centrally aligned with the central axis A. In alternative embodiments more or fewer legs 240*a*, 240*b* may be provided. The light scattering optics structure 250 includes a plurality of individual substantially flat faces 251*a-c* provided therearound. In the depicted cross-section twelve faces are visible, but only three faces 251*a-c* are marked for simplicities sake. It is understood that the light scattering optics structure 250 includes many more flat faces, which would be visible at other cross-sections rotationally offset from the depicted cross-section. For example, light scattering optics structure 250 may have a number of distinct substantially flat faces provided therearound in a similar manner as a disco ball. The light scattering optics structure 250 reflects and/or refracts light emitted by the LED 230 and scatters the light out and through the bulb 218. In some embodiments the light scattering optics structure 250, angled legs 240*a*, 240*b*, and/or the bevel 234 may be constructed from a material such as, for example, polycarbonate, acrylic, or silicon. In some embodiments the light scattering optics structure 250, angled legs 240*a*, 240*b*, and/or the bevel 234 may be cohesively formed.

Although specific configurations of light scattering optics structures 50, 150, and 250 are depicted herein, one of ordinary skill in the art having had the benefit of the present disclosure will recognize that in alternative embodiments alternative configurations may be utilized. For example, in some embodiments alternative shapes may be utilized such as, for example, a desired generally diamondoid shape. Also, for example, a variety of shapes such as facets may be present on some of or the entire surface of a scattering optics structure. Also, for example, incandescent filament shape optics may be utilized such as, for example, a fly-eye lens or web lines. The size and/or configuration of the optics structures may be defined according to, among other things, the beam angle of the light output, the distance between the LEDs and the scattering optical structure, and/or the desired light output characteristics of the LED light bulb.

Although specific configurations of mounting structure 40, 140, and 240A-C are depicted herein, one of ordinary skill in the art having had the benefit of the present disclosure will recognize that in alternative embodiments alternative configurations may be utilized. For example, in some embodiments alternative shapes may be utilized for the mounting structure such as, for example, generally rectangular, triangular, and/or multi-faceted. Also, for example, in some embodiments the mounting structure may be additionally or alternatively coupled to other structure of the LED light bulb. For example, in some embodiments mounting structure may be coupled to and depend from the bulb 18, 118, 218. In some versions of those embodiments the mounting structure may be adhesively coupled to the bulb 18, 118, 218 and in other versions the mounting structure may be cohesively formed with the bulb 18, 118, 218.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing in the claims between parentheses, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A LED light bulb, comprising:

a connection base having at least one electrical contact;

a support atop said connection base;

a plurality of LEDs coupled to said support and disposed about an axis, each of said LEDs producing a LED light output and electrically coupled to said electrical contact;

a plurality of narrow beam optical pieces, each of said optical pieces provided adjacent a single of said LEDs and intersecting at least some of said LED fight output thereof;

wherein intersected said LED light output combines with any non-intersected said LED light output to form modified LED light output, said modified LED light output of a more narrow beam angle than said LED light output;

wherein the narrow beam optical pieces are off-axis optical pieces that redirect LED light output from each of the respective LED in a non-symmetrical fashion with respect to a central LED light output axis of that LED;

a scattering optics structure intersecting said axis, said scattering optics structure offset from said LEDs in a direction along said axis; and a mounting structure coupled to and supporting said scattering optics structure;

a lucent bulb structure surrounding at least said scattering optics structure;

wherein a majority of said modified LED light output is incident on said scattering optics structure and at least some of said modified LED light output is transmitted through said scattering optics structure; and wherein said scattering optics structure scatters said modified LED light output out and through said lucent bulb structure.

2. The LED light bulb of claim 1, wherein said lucent bulb structure is transparent.

3. The LED light bulb of claim 1, wherein said scattering optics structure includes a multi-faceted annular periphery.

4. The LED light bulb of claim 3, wherein said scattering optics structure includes a recessed convex lower surface interior of said periphery and generally facing said LEDs.

5. The LED light bulb of claim 1, wherein said LEDs are mounted in substantially planar relation to one another.

6. The LED light bulb of claim 1, wherein at least three of said LEDs are provided, said LEDs being substantially symmetrically positioned about said axis.

7. The LED light bulb of claim 1, wherein said mounting structure is a single column extending from adjacent said LEDs along said axis.

8. The LED light bulb of claim 7, wherein said column is concave and reflective between said optical pieces and said scattering optics structure.

9. The LED light bulb of claim 1, wherein said modified LED light output has a beam angle of less than eleven degrees.

10. LED light bulb, comprising:

a connection base having at least one electrical contact, said connection base centered on a longitudinally extending bulb axis;

a support atop said connection base;

a plurality of LEDs substantially symmetrically arranged about said bulb axis, each of said LEDs producing a LED light output;

a scattering optics structure centered on said bulb axis and offset from said LEDs;

a mounting structure coupled to said support and coupled to and supporting said scattering optics structure;

a plurality of off-axis narrow beam optical pieces, each of said optical pieces provided adjacent a single of said LEDs and intersecting at least some of said LED light output thereof;

a lucent bulb structure surrounding at east said scattering optics structure;

wherein intersected said LED light output combines with any non-intersected said LED light output to form modified LED light output having a beam angle of zero to twenty degrees;

wherein a substantial majority of said modified LED light output is incident on at least one of said scattering optics structure and said mounting structure;

wherein at least some of said modified LED light output is transmitted through said scattering optics structure; and wherein said scattering optics structure scatters said modified LED light output out and through said lucent bulb structure.

11. The LED light bulb of claim 10, wherein said connection base is of the Edison type.

12. The LED light bulb of claim 10, further comprising a bezel structure surrounding said LEDs and retaining said optical pieces.

13. The LED light bulb of claim 10, wherein said scattering optics structure includes a recessed convex lower surface generally facing said LEDs.

14. The LED light bulb of claim 13, wherein said scattering optics structure includes a recessed concave surface opposite said convex surface.

15. The LED light bulb of claim 10, wherein said mounting structure is lucent.

16. The LED light bulb of claim 15, wherein said mounting structure is reflective.

17. The LED light bulb of claim 10, further comprising a first magnetic structure coupled to said scattering optics structure and a second magnetic structure vertically offset from said scattering optics structure and said first magnetic structure; wherein said first magnetic structure and said second magnetic structure are arranged in a magnetically opposed manner with respect to one another, thereby causing said first magnetic structure and said scattering optics structure to be repelled away from said second magnetic structure.

* * * * *